US012789078B1

(12) United States Patent
Perlstein

(10) Patent No.: US 12,789,078 B1
(45) Date of Patent: Nov. 10, 2026

(54) TEAM BUILDING FOR A GAME EMPLOYING COLLECTIBLE PINS AND SIMILAR WITH CUSTOMIZABLE ELEMENTS

(71) Applicant: Cleromancy Games, East Rutherford, NJ (US)

(72) Inventor: Dennis Perlstein, Crown Point, IN (US)

(73) Assignee: Cleromancy Games LLC, Crown Point, IN (US)

( * ) Notice: Subject to any disclaimer, the term of this patent is extended or adjusted under 35 U.S.C. 154(b) by 345 days.

(21) Appl. No.: 18/480,438

(22) Filed: Oct. 3, 2023

Related U.S. Application Data

(63) Continuation-in-part of application No. 18/365,193, filed on Aug. 3, 2023, now abandoned.

(60) Provisional application No. 63/586,561, filed on Sep. 29, 2023.

(51) Int. Cl.
*A63F 9/00* (2006.01)
*A44C 1/00* (2006.01)

(52) U.S. Cl.
CPC ..... *A63F 9/001* (2013.01); *A44C 1/00* (2013.01); *A44D 2203/00* (2013.01); *A63F 2009/0023* (2013.01)

(58) Field of Classification Search
CPC ..... A44C 3/001; A63F 9/0811; A63F 9/001; A63F 2009/0023; A63F 1/02; A63F 1/04; A63F 2001/025; A63F 2001/027; B44C 1/28; G09F 3/207; G09F 7/00; A63H 3/08; A63H 3/10; A63H 33/16; A63H 33/38; A63H 33/42
See application file for complete search history.

(56) References Cited

U.S. PATENT DOCUMENTS 932,480 A * 8/1909 Little ..... A44C 3/001 40/1.6
1,063,577 A * 6/1913 Moran ..... G09F 7/00 229/92.8
1,426,487 A * 8/1922 Laux ..... A44C 3/001 40/1.5
2,011,722 A * 8/1935 Luhn ..... B42F 17/32 434/127
2,370,229 A * 2/1945 Buckley ..... A63F 9/0811 273/142 HA (Continued)

FOREIGN PATENT DOCUMENTS

DE 4330526 C1 * 3/1995 ..... A44C 3/001

OTHER PUBLICATIONS

Bibliography and Abstract of DE4330526 (Year: 1995).*

*Primary Examiner* — Brian O Peters
(74) *Attorney, Agent, or Firm* — Stites & Harbison PLLC; James R. Hayne

(57) ABSTRACT

Described herein is team building for a game employing collectible pins or similar with customizable elements. It comprises a character representation that is removably fastened to one or more customization elements that grant powers or abilities to the character representations. They further track the progress of the game by revealing customization elements as they are turned in the progression of a stack. Customization elements contain several indicial providing game elements, instructions and tracking the progress of the game.

2 Claims, 11 Drawing Sheets

(56) References Cited

U.S. PATENT DOCUMENTS

| | | | | | |
|---|---|---|---|---|---|
| 2,441,002 | A * | 5/1948 | Berglund | A44C 3/001 | 40/1.6 |
| 2,795,427 | A * | 6/1957 | Sachs | A63F 9/34 | 273/153 R |
| 3,102,635 | A * | 9/1963 | Werwin | B65D 85/544 | 312/9.58 |
| 2010/0186273 | A1 * | 7/2010 | Jones | G09F 7/00 | 40/446 |
| 2018/0368547 | A1 * | 12/2018 | Grannan | A45C 11/182 | |

* cited by examiner

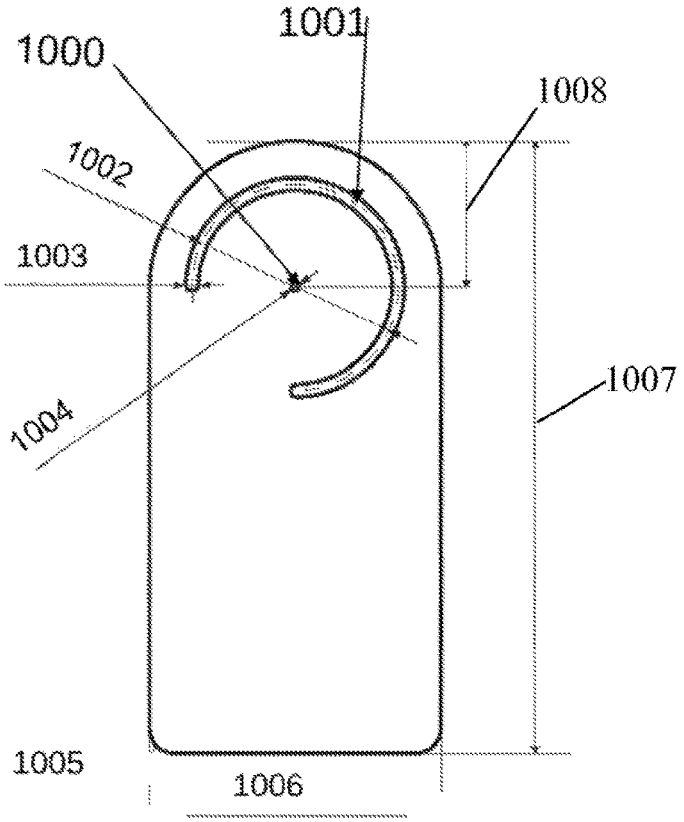
FIG. 10A
FIG. 10B
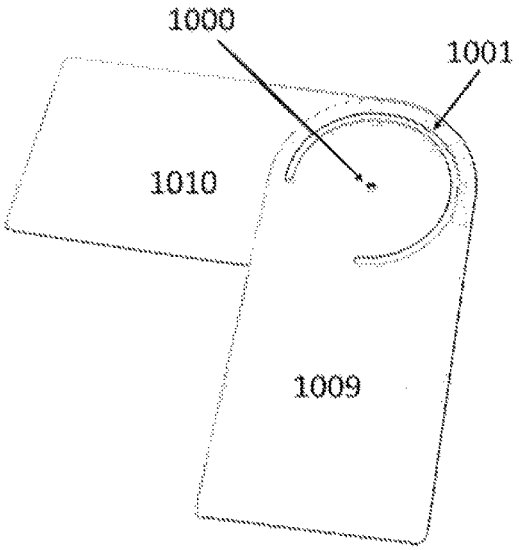

TEAM BUILDING FOR A GAME EMPLOYING COLLECTIBLE PINS AND SIMILAR WITH CUSTOMIZABLE ELEMENTS

CROSS-REFERENCE TO RELATED APPLICATION

This application is a continuation-in-part of U.S. patent application Ser. No. 18/365,193, filed Aug. 2, 2023, which is incorporated by reference herein in its entirety. This application claims the benefit of U.S. Provisional Patent Application No. 63,586,561, filed Sep. 29, 2023, which is incorporated by reference herein in its entirety.

BACKGROUND

Collecting pins or magnets, which represent affiliations with events or places, has grown in popularity in recent years. These pins are often used as promotional items at events like baseball games and are actively traded, with their value primarily attributed to specific ornamentations, such as logos of All-Star Games, rather than any intrinsic qualities. Trading cards are exchanged by enthusiasts to complete sets or acquire rare cards. The cards' monetary worth is determined by the popularity of the depicted individuals and their scarcity, with some cards being more common and others more valuable. The document describes a game using collectible pins, magnets, or similar items, allowing customization within set rules using additional game elements. It outlines the rules and methods for combining the customization elements with the character representations on the pins or magnets, enabling players to engage in gameplay using these personalized characters.

BRIEF DESCRIPTION OF THE DRAWINGS

The present description will be understood more fully when viewed in conjunction with the accompanying drawings of various examples of graphical user interfaces with dynamic containers and variables. The description is not meant to limit the graphical user interfaces with dynamic containers and variables to the specific examples. Rather, the specific examples depicted and described are provided for explanation and understanding of graphical user interfaces with dynamic containers and variables. Throughout the description the drawings may be referred to as drawings, figures, and/or FIGs.

FIG. 10A illustrates a customization element, with additional support, according to an embodiment FIG. 10B illustrates a customization element, rotated to display a customization element below, according to an embodiment.

DETAILED DESCRIPTION

Figure 1:
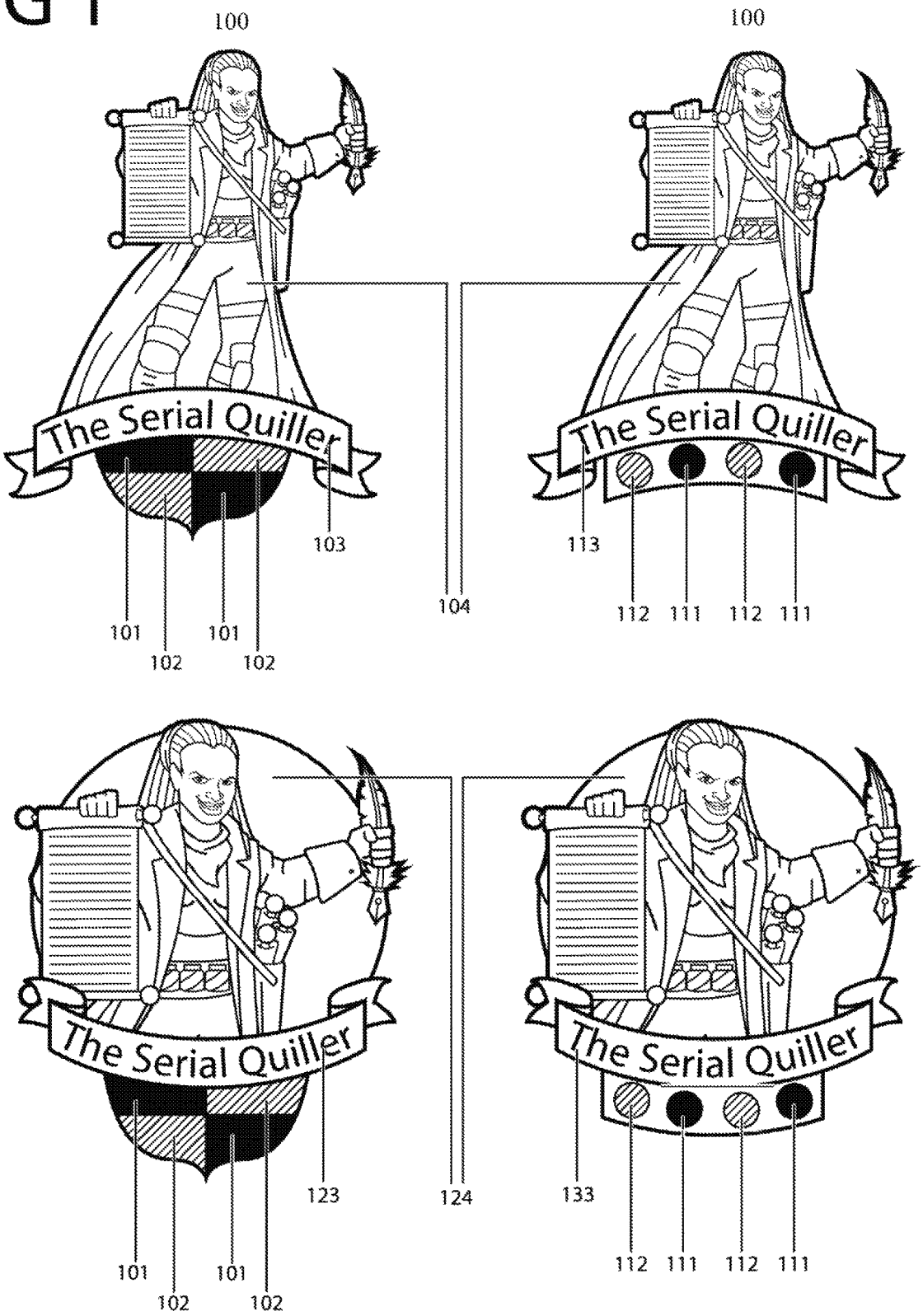
FIG. 1 illustrates examples of character representation elements in an embodiment.

Team building for a game employing collectible pins or similar with customizable elements as disclosed herein will become better understood through a review of the following detailed description in conjunction with the figures. The detailed description and figures provide merely examples of the various embodiments of the Team building for a game employing collectible pins or similar with customizable element. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional game involving pins or magnets may involve a puzzle game where the pins or magnets are simply the mechanical components of a puzzle game. For example, pins or magnets allow for the creation of puzzles using individual pieces that can be assembled and disassembled using these pins or magnets. By employing these elements, the puzzle pieces can be securely attached together, providing an engaging and interactive puzzle-solving experience. The use of pins or magnets ensures that the puzzle remains intact during assembly and can be easily disassembled for repeated play. The magnets or pins serve only as mechanical fasteners for the puzzle. The individual puzzle pieces have no significance beyond their simple, utilitarian usage as parts of the puzzle. When compared to collectible pins or artistic game pieces, magnetic puzzle pieces are not designed with the intent to engage with the player. There is no emotional connection or psychological association with the puzzle piece and it is not collectable or part of a story.

Team building for a game employing collectible pins or similar with customizable elements produces pins that have significance beyond their utilitarian role in part of a separate game. Through the customization of pins that are involved in a broader collectible game, the pins or magnets become more than simple gaming pieces. Players associate the pins with the individual decorations, and the experiences in the game and see them as individual elements of self-expression instead of utilitarian components to play a game.

A conventional collectible pin or magnet is seen as decoration or jewelry. Collectible jewelry pins or magnets have become a prevalent and cherished aspect of trading culture. People engage in trades for various reasons, such as the uniqueness of these items, their perceived value, personal preferences for the depicted art or characters, or even the desirability of a specific collector's number. Trading has become an integral part of the background art of pin or magnet collecting, leading to the development of dedicated websites and mobile applications designed solely to facilitate these exchanges. Even entertainment industry leaders recognize the significance of pin trading, designating specific areas in theme parks where enthusiasts can connect with others interested in engaging in these exchanges.

For conventional collectors' pins, for example, offer opportunities to modify a pin's appearance, but such alterations do not affect the pin's functionality. Simply changing a pin, magnet, or character representation alone does not signify a dynamic game state in a method of play, unless explicitly defined otherwise. The introduction of a method of play and team building for a game centered around collectible pins or similar customizable elements provides a more dynamic experience. If the method's state remains static, players cannot exert influence or adapt to changes introduced by other players or chance within the gameplay. Hence, a method of play must allow players to influence it; otherwise, it cannot be considered a true method of play. Since any viable method of play relies on change triggered by player agency or chance, the capacity to display these state changes becomes essential for its existence.

The introduction of a method of play and team building for a game centered around collectible pins or similar customizable elements gives rise to services catering to trades, auctions, or sales of these game elements. Just like with pins and magnets, trading in this context is motivated by factors like perceived value, artistic preferences, depicted characters, collector numbers, artist's signatures, and even unique manufacturing defects. However, a significant distinction from traditional pins or magnets is that the game elements in this context possess unique functionalities within the game itself. Consequently, trades are also driven by the strategic advantages an element offers, with players seeking to acquire elements that align with their preferred gameplay strategies. Additionally, synergistic interactions between elements contribute to the desirability of certain game components, making them more appealing to players who already possess components that complement each other effectively. The game's dynamic interplay of collectible elements, team building, and strategic gameplay creates an engaging and evolving experience for players within the realm of collectible pin-based gaming—not unlike collectible card gaming.

Part of the allure of collectible card games lies in the emotional attachment players develop towards individual cards beyond their function within the game. Each card often features unique artwork, lore, or thematic elements that resonate with players on a personal level, evoking feelings of nostalgia, admiration, or excitement. Players may form connections with specific cards based on their favorite characters, iconic moments, or memorable experiences related to those cards during gameplay. These emotional attachments add a layer of sentimental value to the physical or digital cards, turning them into cherished possessions rather than merely tools for gameplay. As a result, collectible card games not only engage players strategically but also tap into their emotions and imagination, making the experience more immersive and rewarding.

A conventional collectible card game may involve the exchange of cards among enthusiasts to complete sets or collect rare cards. These cards hold economic and historic value, with their monetary worth influenced by the popularity of the depicted characters and their availability. The popularity of these games has led to the emergence of competitive gaming scenes, where players compete in organized tournaments and events. Still, the cards themselves remain static, discrete items that players simply acquire. Customization and self-expression come only from the selection of cards and assemblies of collections: not from the individual cards themselves.

A conventional way to customize collectible cards includes covering the cards in translucent covers or placing magnetic overlays serve only to augment the card. They do not change the card itself. As of today, no games have been reported that successfully blend the collectible aspect of pins or magnets commonly collected, traded, and sold at special events such as concerts, sporting events, or conferences. While various collectible card games have gained immense popularity, the unique and tangible appeal of pins and magnets remains relatively untapped in the gaming realm.

FIG. 1 illustrates examples of character representation elements 100 in an embodiment. Pins, magnets, or some similar component depict the characters which are represented as battling in the context of the method of play. Character art 104 is presented as a depiction of the character's physical appearance. Character art 104 can be subject to various artistic interpretations with some characters depicted on multiple pins with differences such as but not limited to alternate poses, gear, color schemes, illustrating artist, cropping, scale, or material composition. In addition, representations of characters can be minted in a wide variety of editions such as open edition character art 104 printed in any number, limited time edition character art 104 to be printed in any number but available only for limited amounts of time, fixed edition character art 104 which are printed in an exact number such that there are a set number of that version of the pin to be collected in existence, and fixed source character art 104.

A character can also be depicted on a character art background 124, further providing opportunities to expand artistic interpretation. In an embodiment, a simplistic approach is taken with character art backgrounds 124, featuring solid colors that accentuate and highlight the character's design. Alternatively, in other embodiments, character art backgrounds 124 are thoughtfully crafted to portray genre-specific artistic scenes, immersing the character in a thematic environment that enhances the storytelling aspect of the game. These varied character art backgrounds 124 contribute to the pins' overall appeal, providing players with a range of aesthetic choices and enriching the collectible pin gaming experience. The also provide new features to make pins that are more collectible.

For either character art 104 or character art backgrounds 124, pins can be printed in any number but are available exclusively through specific sources, such as those that come with a purchase above a certain amount threshold or through a certain platform, or those that can only be acquired by participating in specific activities. Such alternate character art 104 may be functional replicas of the game elements of which they are variations such that they serve exactly the same purpose within the confines of the method of play, with either being interchangeable at any point during the method of play with no change to the game state itself, or they may be mechanically unique variations whereby the artistic differences convey additionally some different mechanic in game whether it be different attributes, different game abilities, or some other variation.

Variation can also come from the presentation of the character name 103. In an embodiment, the character name separates space on the pin from the character art 104 and the character background art 124, and the rest of the pin. That space can contain further elements. In an embodiment, the pin contains both indicia and aspects. Further to the embodiment, each indicia and each aspect comprise at least two options. For example, a first indicia is presented in a first aspect 101 for a pin presenting a character. Visually, the first indicia is presented in a first aspect 101 as an abstract artistic element of the overall design. In an embodiment, a first indicia is presented in a first aspect 101 as a solid field in a fantasy heraldry. In the same embodiment, a first indicia is presented in a second aspect 102 as a striped field in the fantasy heraldry. In a different embodiment, a second indicia is presented in a first aspect 111 as a solid decoration presented the character name 103. A second indicia is presented in a second aspect 112: a striped decoration.

Each character representation 100 has some number of indicia to convey the attributes the character representations 100 must use when selecting customization elements. Two Indicia of the black attribute indicate that no more than two customization elements with black attributes may be selected for this character representation element 100. Two indicia of the striped attribute indicate that no more than two customization elements with striped attributes may be selected for this character representation.

In an embodiment, the elements of a character representation element 100 can significantly vary from genre to genre, allowing for creative design choices that align with the theme and atmosphere of each setting. For instance, in a fantasy setting, a character name 103 might be elegantly inscribed on a weathered scroll, evoking a medieval and mystical feel. In a sci-fi setting, the character name 103 could appear as holographic text, reflecting a futuristic and technologically advanced environment. Similarly, in a post-apocalyptic setting, the character name 103 might be engraved on a makeshift metal plate, symbolizing survival and resilience. In a superhero-themed genre, the character name 103 could be showcased in a bold and stylized comic book font, embodying power and heroism.

Likewise, a first aspect 101 can also undergo distinctive transformations in various genres. In a fantasy setting, the first indicia presented in a first aspect 101 may take the form of knightly heraldry, adorned with intricate designs and symbols that represent honor and chivalry. On the other hand, in a sci-fi setting, the first indicia presented in a first aspect 101 might be an emblematic insignia of a space-faring organization, illustrating advanced technology and intergalactic exploration. In a cyberpunk-themed genre, the first indicia presented in a first aspect 101 could be a neon-lit icon, embodying a blend of futuristic aesthetics and urban grit. In a steampunk world, the first indicia 101 may incorporate gears and cogs, symbolizing the fusion of Victorian-era machinery and speculative science.

In the same manner, character art backgrounds 124, the visual depictions in a fantasy setting often draw from common fantasy elements, such as sprawling medieval landscapes with castles, mythical creatures like dragons and unicorns, ancient forests with enchanting glows, and mystic runes etched in stone. In contrast, a sci-fi setting's character art background 124 could feature cosmic vistas with futuristic cities floating among stars, high-tech laboratories with advanced machinery, alien landscapes inhabited by otherworldly beings, and cybernetic structures with glowing neon lights. In a wild west or Western genre, the character art background 124 might showcase vast desert plains, saloons with swinging doors, and iconic cowboy symbols like cowboy hats and horseshoes. Similarly, in a modern urban setting, the character art background 124 could portray bustling cityscapes with skyscrapers, street graffiti, and contemporary symbols representative of the urban lifestyle.

Figure 2:
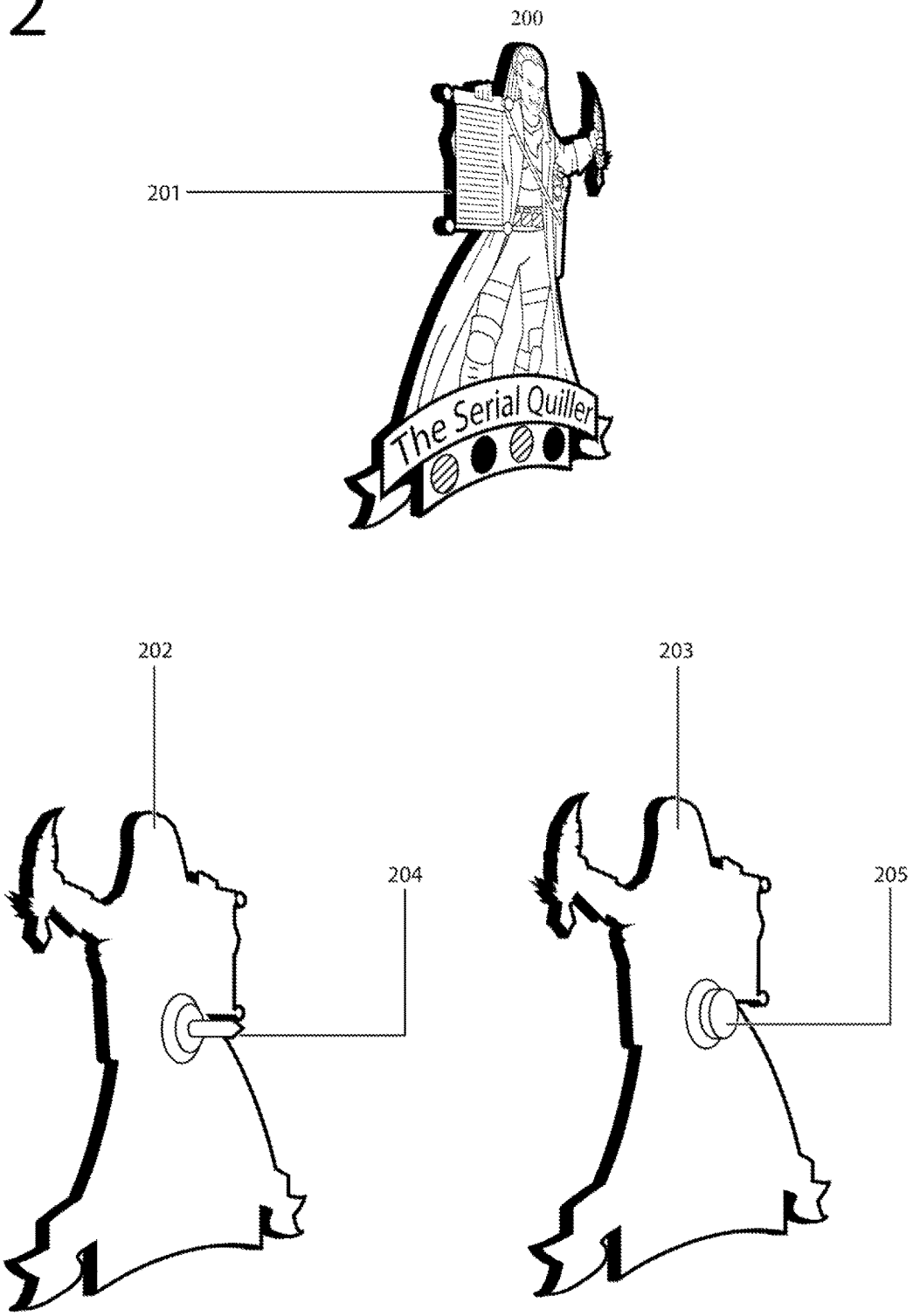
FIG. 2 illustrates possible examples of a character representation element's implementation, according to an embodiment.

FIG. 2 illustrates possible examples of a character representation element's 100 implementation, according to an embodiment. The character representation element 100 includes a character front that shares a body with a back. In an embodiment, the back is a pin post back 202. In various embodiments, different approaches of producing the pin post back 202 ensure a secure and reliable connection. One commonly used method is soldering, where the pin post 204 component is heated and fused to the pin post back 202 of the character front 201, creating a strong and permanent bond. Another approach is riveting, wherein the pin post 204 is inserted through a hole in the character front 201, and a rivet is then fastened to secure it in place. This technique provides a durable and mechanical attachment. For a more subtle and seamless look, adhesives and epoxy can be used to affix the pin post 202 discreetly to the pin post back 204 of the character front 201. Additionally, for mass production, injection molding or casting techniques can be employed to create a single, integrated piece that incorporates both the character front 201 and the pin post 204 and the pin post back 204.

Attaching a magnet 205 to the magnet back 203, offers several versatile approaches to ensure a secure and functional connection. One common method is using adhesive materials specifically designed to adhere to metal surfaces, effectively bonding the magnet 205 to the magnet back 203. This adhesive approach provides a seamless and inconspicuous attachment, maintaining the integrity of the character front 201. Additionally, the magnet 205 can be inset into a cavity within the magnet back 203, creating a flush and stable placement that keeps the magnet concealed while retaining its magnetic properties. For a more robust connection, mechanical fastening techniques like riveting or screws can be employed, creating a durable and long-lasting bond between the magnet 205 and the magnet back 203. The variety of attachment methods allows designers to choose the most suitable option based on the design and intended use of the decorative pin, ensuring a well-crafted and functional magnetized pin for collectors and enthusiasts.

The character representation element 100 on the pin, character front 201, may include the character's name for introducing unfamiliar characters. If using existing Intellectual Properties with widely recognized pre-existing characters, the name may be omitted. The inclusion of character names strengthens the narrative elements of the method of play, leading to player investment in the characters they collect and customize, forming legal teams in the gameplay. Character representation elements 100 have indicia of attributes explicitly displayed on the pin, magnet, or similar component, limiting the types of customized elements available for each character. These attributes, represented by colors or patterns, indicate game strategies, abilities, and character types, enhancing the immersive experience of the shared story in the method of play.

Customization elements 200, added to the character representation 100 and, in an embodiment a magnet 205 or, in another embodiment, a pin post 204, form a connective axis around which one or more customization elements 200 can be removably added to the character representation. The making of waterproof cards involves utilizing cardstock treated with waterproof materials or cutting cards from plastic, with PVC being one of the commonly used polymers. In the case of cardstock, a popular method is to apply a waterproof coating to the surface, protecting the cards from water damage and increasing their longevity. This process involves treating the cardstock with various waterproof substances, such as laminates or sealants, which create a barrier against moisture. In some embodiments, customization elements 200 could even be formed from metal.

Alternatively, cards can be crafted directly from waterproof materials like plastic, where PVC (Polyvinyl chloride) stands out as a widely used polymer. PVC is known for its exceptional waterproof properties, making it an ideal choice for creating durable and long-lasting waterproof cards. Through a cutting process, intricate card designs can be precisely shaped from PVC sheets, ensuring the final product remains resistant to water, spills, and other environmental factors.

Both methods of creating waterproof cards offer advantages to suit different needs. Treated cardstock provides a more traditional feel and can be a cost-effective option for certain applications. On the other hand, plastic cards, especially those made from PVC, deliver unparalleled water resistance and durability, making them perfect for applications where frequent exposure to moisture is expected, such as outdoor activities, water-based events, or in humid environments.

Weatherproof customization elements 200 is important so as to promote the wearability of the character representation 100/customization element 200 construct. Whereas the formation of weatherproof decorative pins is known, from metals, resins or plastics, embodiments of the invention need be intentional to create customization elements 200, which share elements of playing cards, that are also similarly resistant to atmospheric conditions.

Figure 3:
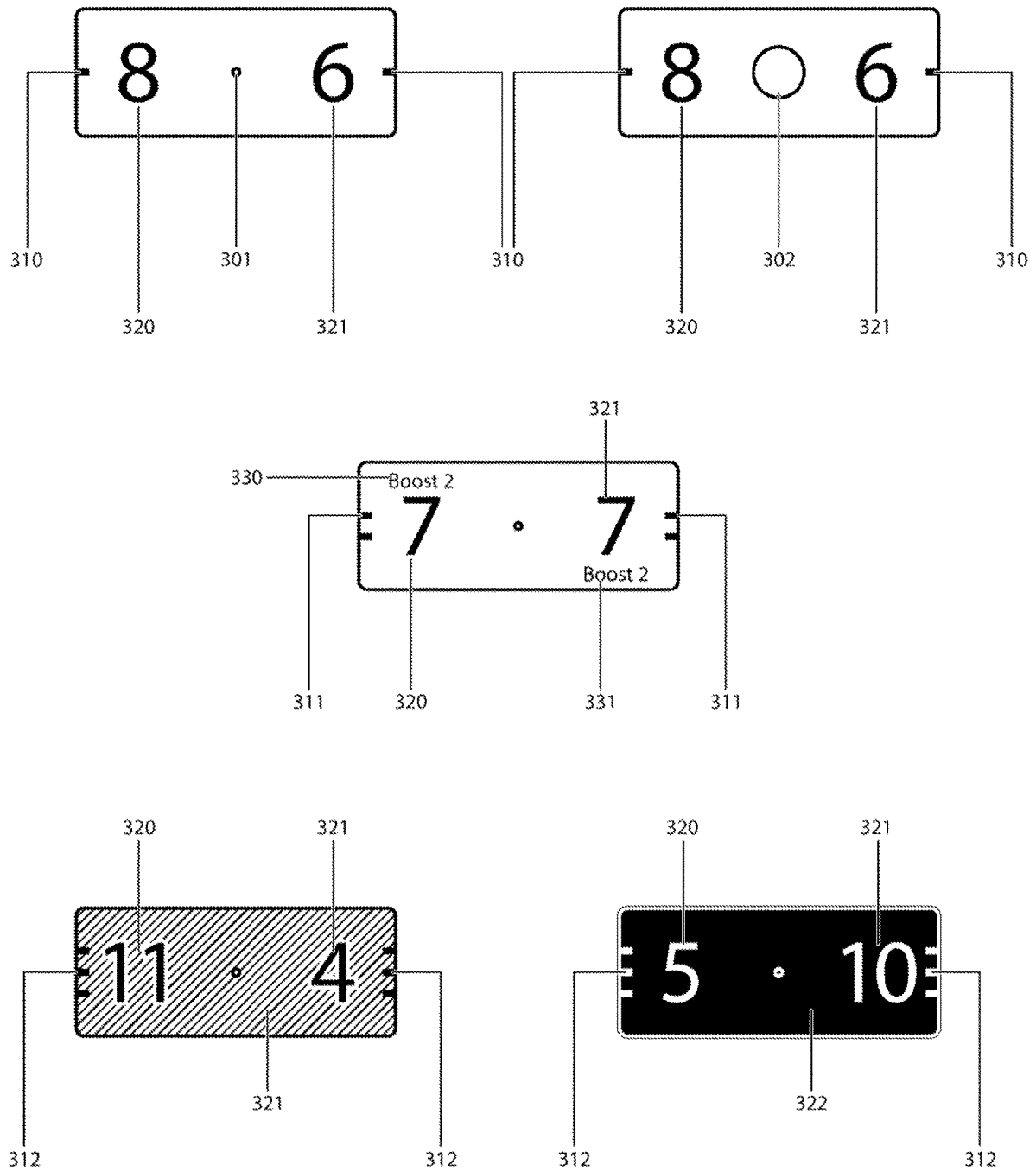
FIG. 3 illustrates customization elements to be used to customize character representations for the method of team building, in an embodiment.

FIG. 3 illustrates customization elements 300 to be used to customize character representations for the method of team building, in an embodiment. The present invention introduces customization elements with unique functionality within the method of play. Players can trade differing game elements from background methods of play to acquire components that enhance their desired strategy or synergy between collected elements. The indicia on these customization elements, such as attributes, attack stats, defense stats, abilities, and other stats, contribute to their distinct mechanical nature, making them desirable for trading, similar to cards in traditional methods of play.

Combining collectible elements for the method of play with pins, magnets, or similar components, the present invention is expected to generate significant demand for trading and reselling, similar to the current state of the art in pins, magnets, and collectible card methods of play. While character representations on pins or magnets may appeal to collectors due to the depicted character or artistic merit, the unique mix of attributes described on these representations confers distinct functionality within the method of play. This functionality can align with a player's preferred strategy or synergize with other owned or desired customization elements and character representations, introducing a novel combination of collectible markets not previously described.

In an embodiment, the pin post 204, is received by a pin post hole 301 to create an assembly where the customization element 200 is removably coupled to the pin post back 202 of the character representation. Customization elements 300 like cards or similar elements with a small hole for pin insertion or magnetic spinning can be designed with printed information and rotated around the pin post 204 or magnet 205 throughout the game to reflect the changing state. This rotation alters the functions of character representations 201 by revealing information on the next element in the stack. The customization elements 300 modify the character representation's 201 functionality with attack stat 320, defense stat 321, and various game abilities indicated by indicia. Special combinations of customization elements 300 may grant additional stats or abilities, and each element could be assigned attributes corresponding to those on character representations 201, influencing the method of team building 111 and gameplay strategies.

Alternatively, for pins intended for magnetic attachment, a magnet 205 can be embedded into the pin's structure, and a magnet hole 302 is sized to fit snugly around the magnet. This snug fit ensures a strong magnetic connection between the pin and the clothing surface. Additionally, for specialized pins that require more secure attachment, a pin post back 202 can be utilized, featuring a clutch or spring-loaded mechanism that grips the pin post 204 tightly, preventing accidental dislodging and providing a secure hold. In an embodiment, the pin post 204 or the magnet 205 are received by the pin post hole 301 or the magnet hole formed into the customization element.

The customization element adds additional information, visible when looking at the character front 201. It provides a variety of information, relevant to one or more games, and transforms the pin into an element of the game—a character in a game. In an embodiment, customization elements play a crucial role in modifying the functionality of character representations and the presentation of the character front 201. These elements can take the form of cards or similar components with pin post holes, which can be inserted onto the pin post 204 or the body of the magnet 205. By rotating the customization elements around the pin post or magnet pole throughout the game, players can reflect the changing game state and alter the functions of the character representations accordingly. Each customization element can be designed with various attributes for the game, such as attack and defense stats, as well as game abilities represented by indicia on the element's surface.

Customization elements 300 can feature multiple abilities, indicated by specific placements of indicia. These placements convey additional information about the ability, such as its relevance to attack or defense stats, its activation during character or enemy attacks, or specific conditions required for the ability to take effect, ensuring that the same ability repeated on a single customization element may have unique effects. Games often incorporate levels or progression systems that unlock new abilities as players advance in the game. In an embodiment, indicia of stats on the customization element includes the representation of the level of the first level customization element indicator 310. To indicate different levels of customization elements, stripes can be utilized, where multiple stripes can indicate a second level customization element indicator 311 or a third level customization element indicator 312. These stripes visually represent the advancement of the customization element and reflect the character's growth and access to new abilities. In further embodiments, customization elements can extend well beyond the third level customization element indicator 312—only limited by the physical space to make the strips or other marks.

However, alternatives to stripes can also be employed in representing level customization elements, tailored to the specific genre of characters. For instance, military characters may have chevrons, symbolizing their rank and progression within the game, while assassins can have skulls, signifying their mastery and experience. Different genres can have unique visual elements to denote the character's level, enhancing the thematic and immersive experience of the game. The introduction of level-based customization elements adds depth and complexity to the gameplay, encouraging players to strategize and unlock the full potential of their character representations.

Each customization element 200 offers unique attack and defense stats, indicated as attack stat 320 and defense stat 321, respectively. These stats may vary from one customization element 200 to another, allowing players to strategically exchange character fronts 201 with different customization elements 300 during the game. For example, a player might replace a character front with a customization element featuring a higher attack stat 320 to enhance offensive capabilities or opt for one with a higher defense 321 stat to bolster their character's resilience in battles.

Additionally, in an embodiment, customization elements further contain a customization attribute 322. The customization element 200 is represented broadly across the customization element 200, the customization attribute 322 provides a broad category or quality that impacts which interactions in which the character can engage. For example, if a customization element 200 has the customization attribute 322 it can only be used to customize a character representation with one or more indicia of the striped attribute. Likewise, the customization element 200 has the black customization attribute 322 and therefore can only be used to customize a character representation with one or more indicia of the black attribute. Customization attributes 322 can broadly represent categories into which characters align: such as teams, power classifications or other categories.

Customization elements may possess various customization abilities. In an embodiment, abilities can be conveyed through descriptive words, and symbolic representations, on the customization element 200. In an embodiment, the same ability is presented both as a first customization ability 330 and a second customization ability 331. These abilities serve to enrich the character's identity and appearance, allowing creators to tailor unique traits and features to each character. In another embodiment, the first customization ability 330 might manifest as a particular set of skills or attributes that enhance the character's combat prowess, granting them proficiency in wielding certain weapons or elemental powers. On the other hand, the second customization ability 331 could imbue the character with mystical talents, like the ability to manipulate illusions or tap into ancient magic.

Figure 4:
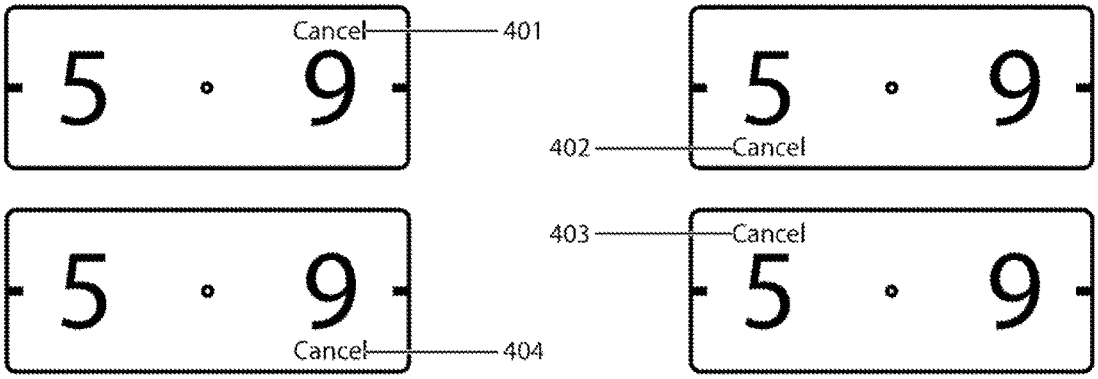
FIG. 4 illustrates additional features of customization elements as they pertain to the method of play, according to an embodiment.
Figure 4:
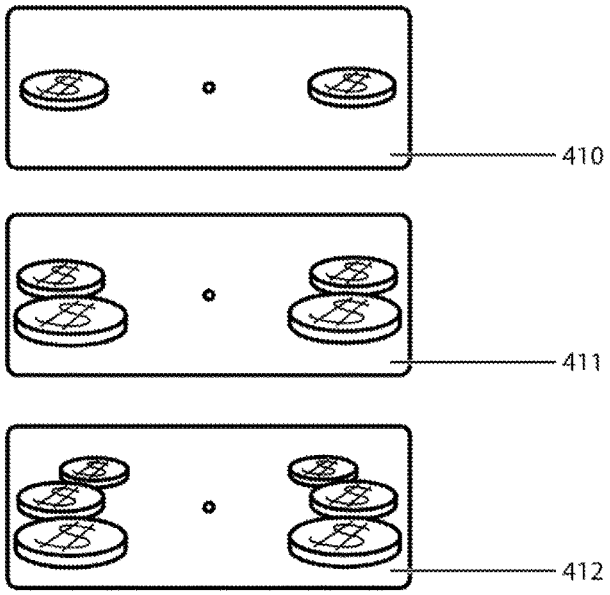

FIG. 4 illustrates additional features of customization elements as they pertain to the method of play, according to an embodiment. Customization elements 300 contain additional features in the context of the method of play. The placement of indicia on these elements 300 provides vital information about the abilities they represent, including the corresponding stat, whether they are offensive or defensive, and any unique rules associated with them. When indicia of an ability appear above the attack or defense stat of a customization element, it signifies an offensive ability that activates when the character performs an attack. Conversely, when indicia are below the attack or defense stat, they indicate a defensive ability that activates when the character is targeted by an opposing player's attack. Furthermore, indicia above or below the attack or defense stat can convey whether the ability modifies attack-related attributes, defense-related attributes, or exclusively pertains to offense or defense, respectively.

In an embodiment, for example, as the first cancel indicia 401 is above the defense stat 321, it is only active when the character representation with this customization element is attacking. When such a character representation attacks, the placement of the indicia near the defensive stat 3321 conveys that the target of the attack will have the abilities modifying the defensive stat of its top customization element canceled. As the fourth cancel indicia 404 is below the defense stat, it is only active when the character representation with this customization element is attacked. When such a character representation is attacked, the placement of the fourth cancel indicia near the defensive stat 321 conveys that the attacking character will have the ability to modify the defensive stat of its top customization element canceled.

As the third cancel indicia 403 is above the attack stat 300, it is only active when the character representation with this customization element 200 is attacking. When such a character representation attacks, the placement of the third cancel indicia 403 near the attack stat 320 conveys that the target of the attack will have the ability to modify the attack stat 320 of its top customization element 200 canceled. As the second cancel indicia 402 is below the attack stat 320, it is only active when the character representation with this customization element 200 is attacked. When such a character representation is attacked, the placement of the second cancel indicia 402 near the attack stat 320 conveys that the attacking character will have the ability to modify the attack stat of its top customization element 200 canceled. In this way, the same ability indicia can convey many different mechanics within the confines of the method of play depending on its placement.

In an embodiment, during the team-building process, the final customization elements 300 play a crucial role in determining the unique attributes of each character representation. These elements are assigned points based on the indicia they bear, with the one-point customization element 410 signifying one point, the two-point customization element 411 signifying two points, and three-point customization element 412 signifying three points. For a team consisting of six-character representations, a balanced approach is taken to ensure diversity and strategic options. Two of each customization element should be assigned across the entire team, ensuring that every character representation receives one such customization element. This distribution allows for a mix of abilities and ensures that no character representation is left without a customization element.

In the case of a smaller team of four-character representations, a different approach is taken. To maintain balance, two customization elements with one-point customization elements 410 are assigned to the team. Additionally, one each of two-point customization elements 411 and three-point customization elements 412 are assigned, offering a variety of customization options to each character representation.

This method of distributing customization elements 300 in team building ensures that every character contributes meaningfully to the team's overall strategy and power. The carefully balanced allocation of points and elements enhances the gameplay experience, encouraging players to consider each character's strengths and weaknesses while forming cohesive and formidable teams. As a result, the team-building process becomes an engaging aspect of the game, where creativity and strategy converge to shape unique and powerful character representations.

Figure 5:
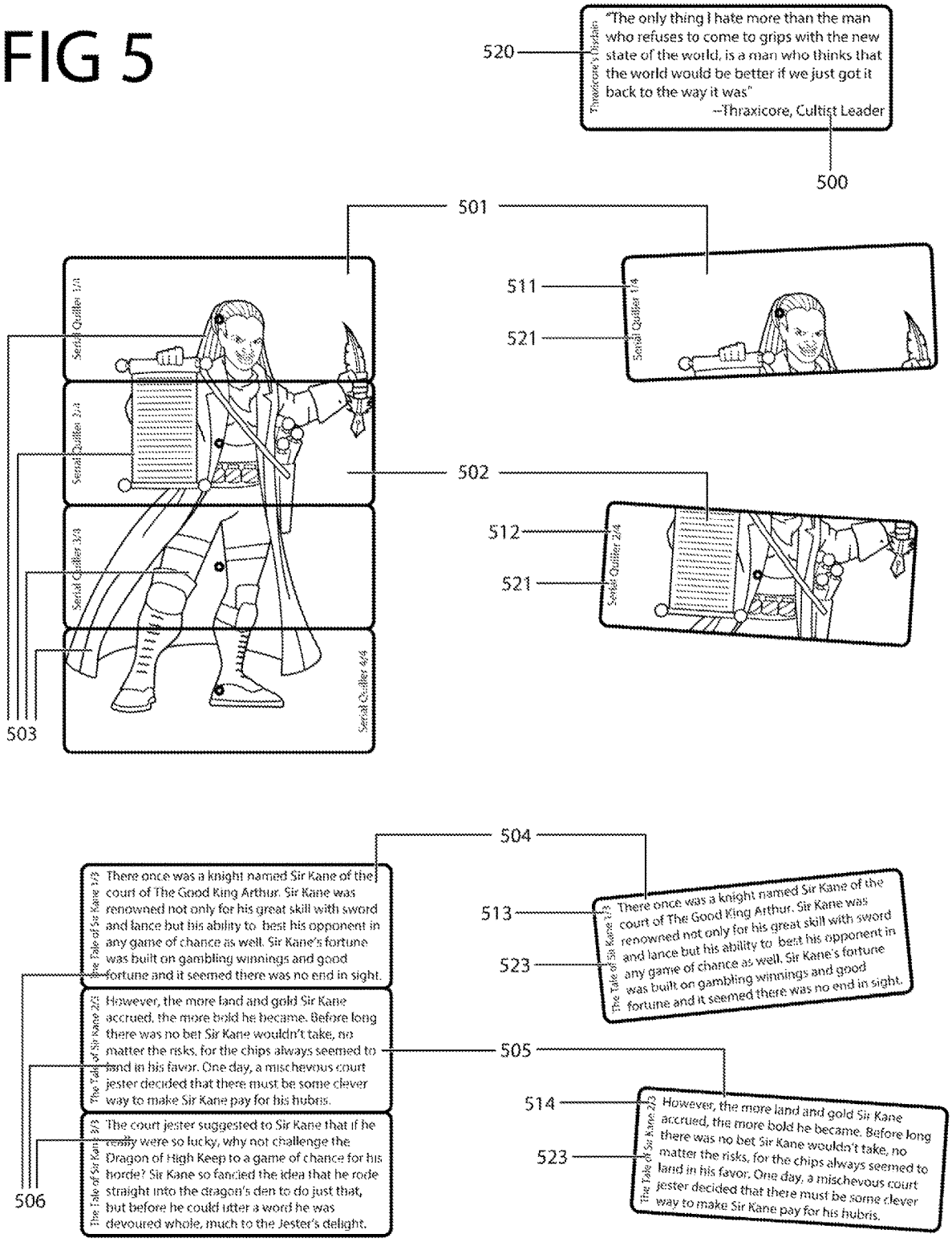
FIG. 5 illustrates examples of how the back of customization elements may be used to display whole or part of collectible artworks, in an embodiment.

FIG. 5 illustrates examples of how the back of customization elements 300 may be used to display whole or part of collectible artworks. In an embodiment. customization elements 300 may be used to display the whole or part of collectible artworks 520. In an embodiment, the back of the customization element 200 contains collectible artwork that is, in its entirety, a narrative quote from a character that is represented within the narrative the method of play is set in. The backs of a first customization element 501 and a second customization element 502 each bear different individual parts of an illustration, which can only be fully viewed once each customization element in the set has been collected and assembled as into the collectible artwork construct 503. A first customization element 501 and a second customization element both have series title indicia 521 of their belonging to the same collectible artwork construct 503. In an embodiment, the series title indicia is the name of a character: "Serial Quiller". However, a first set number indicia 511 indicates that first customization element 501 is the first of four customization elements that make up the collectible artwork construct 503. A second set number indicia 512 indicates that a second customization element 502 is the second of four customization elements that make up the collectible artwork construct 503.

The collectible artwork construct 503 offers an innovative and captivating way to present artwork in the context of the technical specification. In this system, the backs of both the first customization element 501 and the second customization element 502 feature distinct parts of an illustration. However, the full artwork can only be appreciated when all the customization elements in the set have been collected and assembled. This unique approach encourages collectors to acquire and combine multiple customization elements to unveil the complete artwork, adding an element of excitement and anticipation to the process. Furthermore, the series title indicia 521 found on both the first and second customization elements signifies their belonging to the same collectible artwork construct 503. In the embodiment described, the series title indicia represents the name of the character: "Serial Quiller," creating a cohesive theme that ties these elements together. Notably, the collectible artwork construct 503 can comprise more than just two customization elements 300, indicating the potential for larger and more intricate artworks to be created.

For instance, in an embodiment, a collectible artwork construct 503 could be formed from a series of customization elements representing an entire team of characters or a collection of related objects, allowing for the creation of captivating larger images or broader scenes. This not only enhances the artistic value of the collectible elements but also provides collectors with a more comprehensive and immersive experience as they curate and assemble their unique collections.

In a different embodiment, a first story customization element 504 and a second story customization element 505 each bear different individual parts of a short story, which can only be read in its entirety once each customization element in the set has been collected and assembled as collectible story construct 506. The first story customization element 504 and a second story customization element 505 both have story indicia 523 of their belonging to the same collectible story construct 506 titled "The Tale of Sir Kane". However, set number 513 indicates that element 504 is the first of three customization elements that make up the entire piece 506, while set number 514 indicates that element 505 is the second of three customization elements that make up the entire piece 506.

Figure 6:
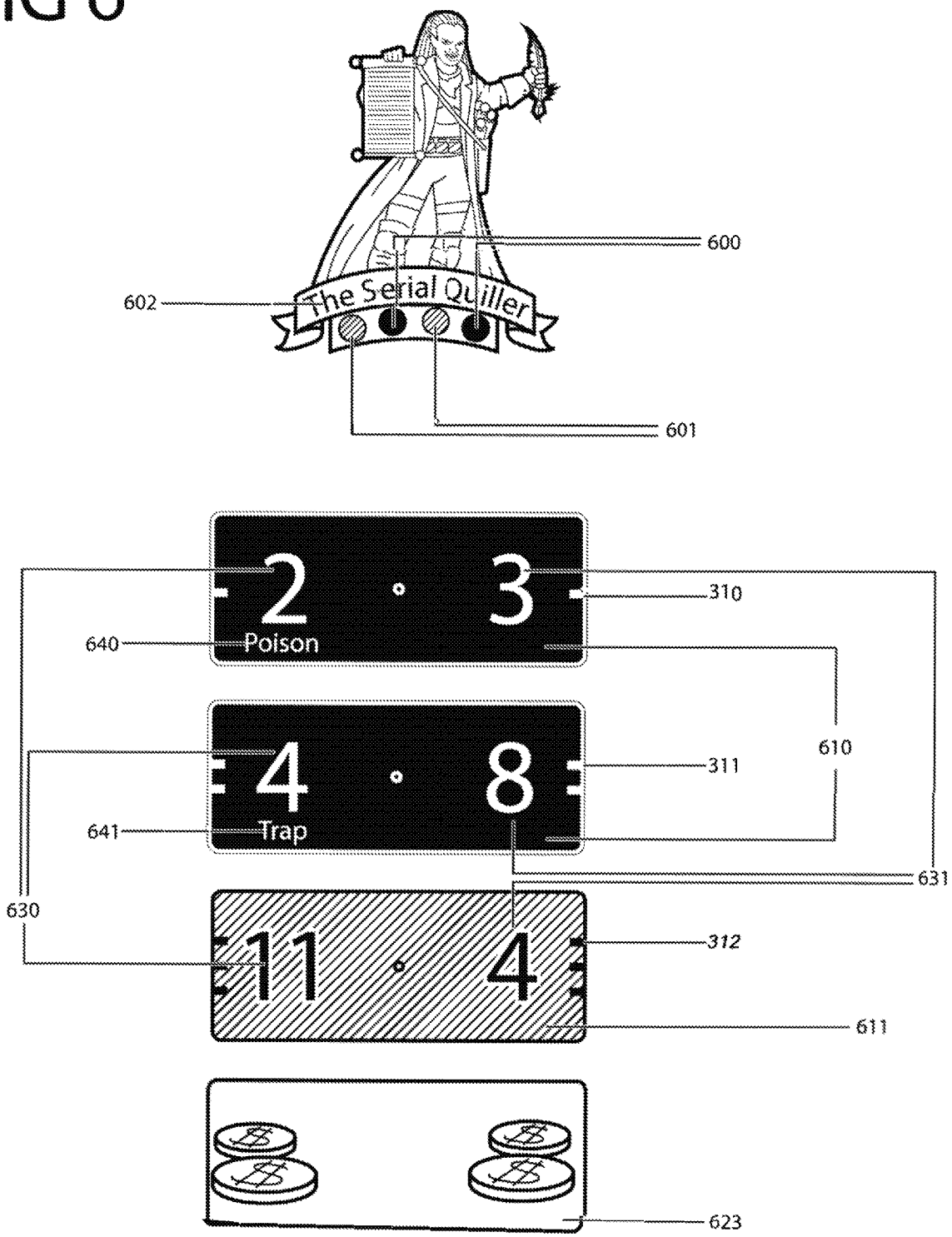
FIG. 6 illustrates possible character representation, and the customization elements that have been selected to customize it for the purpose of team building, according to an embodiment.

FIG. 6 illustrates possible character representation, and the customization elements that have been selected to customize it for the purpose of team building, according to an embodiment. depicts an example of a possible character representation 100, and the customization elements 300 that have been selected to customize it for the purpose of team building. If the team being built is confirmed to have no character that shares a name 103 with the name of the displayed customization element 200, then the character representation 100 depicted may be added to the team. Once the character representation 100 has been chosen, a first indicia presented in an aspect 600 conveys that the character representation 100 can be assigned no more than two customization elements 300 with the black customization attribute. In a further embodiment, the first customization attribute is black. A second indicia, presented in an aspect 601, conveys that the character representation 100 can be assigned no more than two customization elements 300 with the striped customization attribute.

In an embodiment, two customization elements 300 with the first customization attribute 610, which, in an embodiment, is the black customization attribute, have been selected and a single customization element 200 selected with the second customization attribute 611, which, in an embodiment, is the stripped customization attribute. In this way, in an embodiment, no more customization elements of any attribute have been selected for the character representation than allowed by that character representation 100. Finally, each character representation must be assigned a final customization element indicating the number of points that character representation grants an opponent when such a final customization element is revealed: a point customization element 623. In an embodiment, the character representation 100 contains the two-point customization element 411, indicating that this character representation is worth two points when defeated.

The customization elements 300 selected to customize the character representation 100 each have indicia of a different level. In an embodiment, indicia of stats on the customization element includes the representation of the level of the first level customization element indicator 310. To indicate different levels of customization elements, stripes can be utilized, where multiple stripes can indicate a second level customization element indicator 311 or a third level customization element indicator 312. These stripes visually represent the advancement of the customization element and reflect the character's growth and access to new abilities. In further embodiments, customization elements can extend well beyond the third level customization element indicator 312—only limited by the physical space to make the strips or other marks. Each customization element has a variable attack stat 630 and a variable defense stat 631, which differ from one customization element to the next. Each customization element may also have indicia of abilities. For example, a customization element 200 can have a first variable ability 640. In an embodiment, a customization element indicates the character representation will have the poison ability modifying its attack stat 320 when it is attacked, and when achieving a different level customization element, have a second variable ability 641. In an embodiment, when the character representation 100 advances to customization element 200 with a third level customization element indicator 312, then the character representation 100 will get to make a free trap attack when an opponent's attack defeats its level one customization element 200, causing the level two customization element (indicated by the second level customization element indicator 311) to be revealed.

Figure 7:
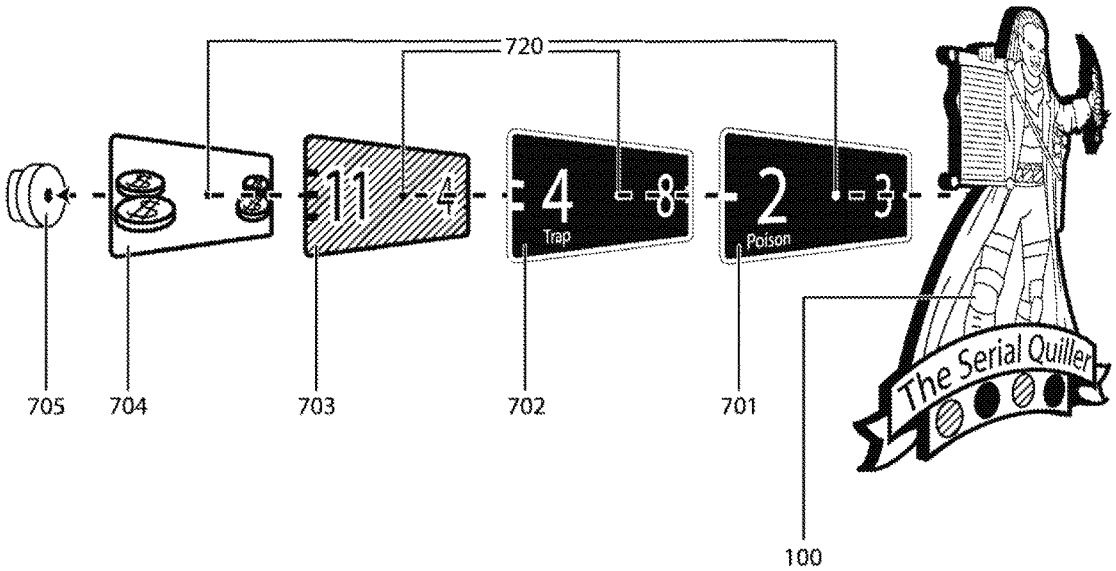
FIG. 7 illustrates the assembly of a character representation, with a pin, according to an embodiment.
Figure 7:
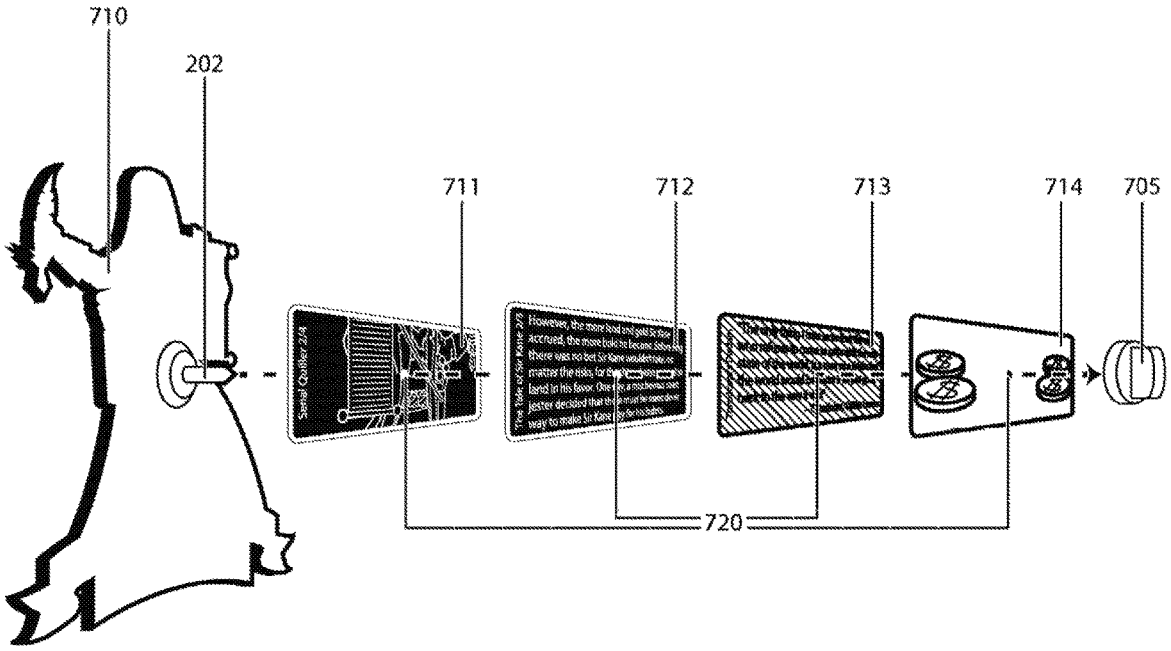

FIG. 7 illustrates the assembly of a character representation 100, in this case with a pin post, with the customization elements that have been selected for it during the method for team building in the present invention. The front of the character representation 100 has the post of its pin post back 202 inserted through the holes series 720 connecting selected customization element. The front of the level one customization element 701 is placed onto the post first, then the front of the level two customization element 702, followed by the front of the level three customization element 703. Then the front of the final customization element 704 is placed onto the pin post. In an embodiment, the final customization element is a point customization element 623.

Methods of play using components such as a deck of cards often necessitate that the backs of said cards are indistinguishable from each other in order to conceal the information on the face of cards. However, the process of obscuring customization elements 200 behind other customization elements 200 as described herein means that customization elements 200 need not be indistinguishable from one another on their reverse side. Consequently, the reverse side of a customization element 200 may be used to represent a completely different customization element 200, thereby allowing a player to select which side of the customization element 200 they wish to present during the team building process.

Finally, a pin backing 705, receives the pin post from the pin post back is put snugly onto the post of the pin. In an embodiment, the pin backing is a pin clutch. In a further embodiment, the clutch is a rubber clutch, featuring a soft and flexible rubber material that grips onto the pin post, providing a tight hold. Another popular option is the butterfly clutch, shaped like a butterfly with two metal wings that fold over the pin post, offering a stable and reliable closure. The push-on clutch is a simple and quick option, where a plastic piece is pushed onto the pin post to hold it in place securely. A locking clutch provides an extra level of security by using a mechanism that requires a separate action, such as twisting or pressing, to release the pin from the post. For those looking for a more permanent solution, the screw-on clutch is ideal, as it requires the user to screw the clutch onto the pin post, ensuring a strong and durable connection.

Character representations 100 can be made from various materials to offer collectors a diverse range of options. In an embodiment, they can be formed from plastic. Acrylic, for example, is a common polymer used to form collectable pins and character representations can similarly be formed from polyethylene or polystyrene. Acrylic pins are popular for their transparency and glossy appearance, allowing for vibrant designs. Polyethylene pins offer a more flexible and durable option, suitable for pins that may undergo moderate stress or bending. Polystyrene pins are lightweight and can be easily molded into intricate designs, making them a cost-effective choice for producing large quantities of pins.

In another embodiment, pins are routinely form from resins, three popular types used for collectible pins are epoxy resin, polyurethane resin, and polyester resin. Epoxy resin pins are highly sought after for their clear, glass-like finish, providing a professional look to intricate designs. For character representations, polyurethane resin pins provide options as they are flexible, impact-resistant, and can be molded in intricate details, making them a durable choice for pins that may be subject to wear and tear. Finally, polyester resin pins offer good chemical resistance and are often used when manufacturing pins with vibrant colors and unique textures.

Collectible pins are also commonly made from various metals, such as copper, brass, and zinc alloy. Copper pins have excellent electrical conductivity and are often used as a base material to enhance the durability and structural integrity of the pin. Brass pins are corrosion-resistant and offer a golden appearance, making them an attractive option for elegant designs. Zinc alloy pins, often mixed with other metals like nickel or copper, are favored for their versatility and affordability, allowing for intricate designs with different finishes. When assembled this way, the stacked and aligned customization elements will hide the information relevant to the method of play on customization elements below it in the stack. Similarly viewed from the back character representation 100 has the post of its pin back 202 inserted through the hole series 720 connecting in each selected customization element 200. The back of the level one customization element 711 is placed onto the post first, then the back of the level two customization element 712, followed by the back of the level three customization element 713. Then the back of the final customization element 714 is placed onto the pin post. Finally, some element such as a pin backing 705 is put snugly onto the post of the pin. Pins assembled in this way could additionally have the post of the pin inserted through some cloth and worn before the pin backing 705 is put on the post of the pin and be worn on the cloth. Pins assembled in this way could also additionally have the post of the pin inserted through some board or mounted on it, in which case they may or may not still require a pin backing 705 be put snugly onto the post of the pin.

In addition to their mechanical purposes within the method of play, the customization elements in the present invention may also feature unique elements unrelated to the gameplay system. These elements could include collectible works of art, such as short stories, game tips, illustrations, or other forms of artistic expression, found on the unused space of the customization elements. These artistic expressions may span across multiple customization elements, further enhancing their collectible nature. Players and collectors may be motivated to seek out and acquire different customization elements to complete a story or artwork spread across them. While some artistic works may be relevant to the method of attack or defense represented by the customization element, others may stand on their own, allowing for creative and diverse artistic additions to the collectible elements.

Team building in the presented method involves selecting character representations 100 and customization elements 200 that align with the defined method of play. Players must choose unique character representations 100, ensuring no two characters with the same name are on the same team. The number of character representations 100 to be selected is predetermined, typically four or six, though it can be adjusted based on mutual agreement. The selected characters are arranged on a lanyard or board in a specific grid layout. Adjacency rules apply to pins, magnets, or similar components placed next to each other. After placing the character representations, players must select customization elements 200 following the specified rules for each character. Customization elements must match the attributes indicated on the character representation 100, and the total number of such elements cannot exceed the character's attribute count.

During the team-building process, players are limited by the level of the customization elements 200 indicated on them. Each customization element 200 has a specific level, and to create a legal team, each character representation 100 must not have more than one customization element 200 of each level. Some customization elements 200 may lack attributes, but they still count towards the limit of one customization element 200 per level. Each character representation 100 must have a certain number of assigned customization elements 200, typically three, but variations in abilities or rules can alter this number. The final customization element 200 is assigned to each character representation to indicate the number of points that character is worth after being defeated. By obscuring the number of points, players can bluff and strategically use this information to gain an advantage in the method of play.

Figure 8:
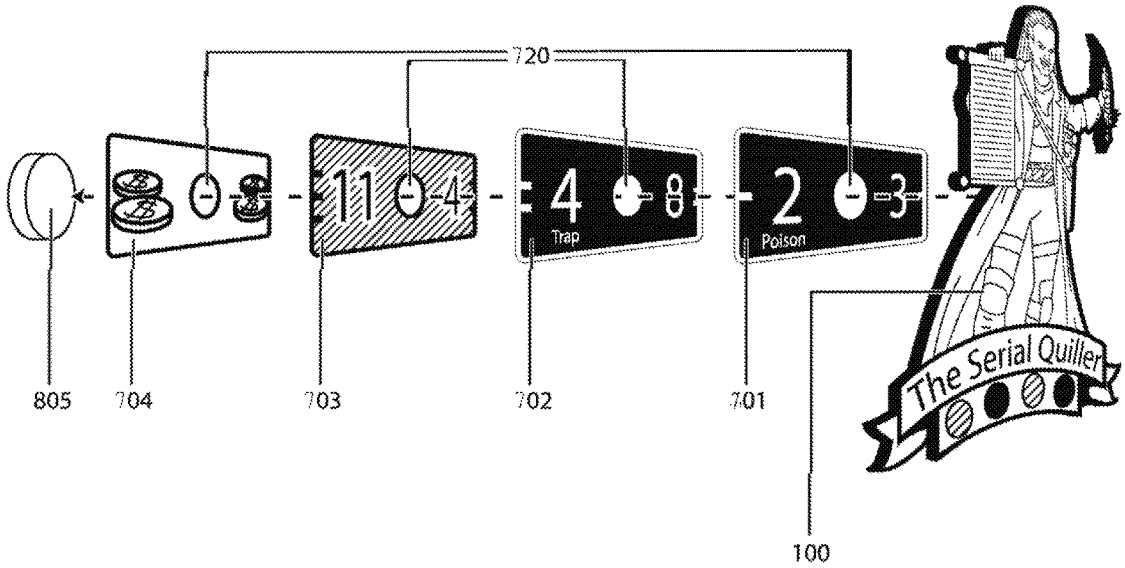
FIG. 8. illustrates the assembly of a character representation, with a magnet, in an embodiment.
Figure 8:
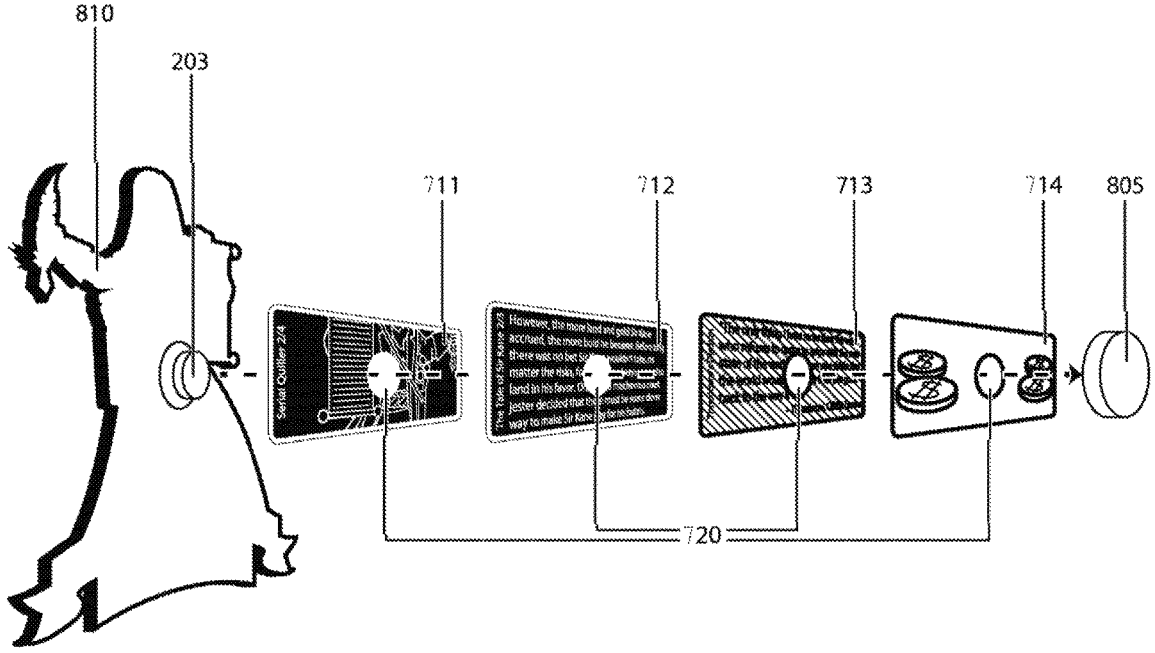

FIG. 8. illustrates the assembly of a character representation 100, in this case with magnet 205, with the customization elements 200 that have been selected for it during the method for team building in the present invention. The front of the character representation 100 has the magnet back 203 traversing the holes series 720 connecting selected customization element 200. The front of the level one customization element 701 is placed onto the post first, then the front of the level two customization element 702, followed by the front of the level three customization element 703. Then the front of the final customization element 704 is placed onto the pin post. In an embodiment, the final customization element is a point customization element 623. Finally, a magnet backing 805, receives the magnet back 203 and is connected snugly to the magnet back 203.

Various sizes and compositions of magnets 205 can be used as a single body to effectively affix the character representation 100 to the magnet backing 805 a lapel pin onto a pin backing. The choice of magnet size and material depends on the weight and dimensions of the lapel pin, as well as the strength of the magnetic force required to securely hold it in place. In an embodiment. neodymium magnets provide strong magnetic pull relative to their size. Neodymium magnets are available in various shapes, such as disc, cylinder, or rectangular, allowing for a tailored fit to the holes series 720 formed by one or more customization elements 200.

When assembled this way, the stacked and aligned customization elements will hide the information relevant to the method of play on customization elements below it in the stack. Similarly viewed from the back character representation 100 has the post of its magnet back 203 inserted through the hole series 720 connecting in each selected customization element 200. The back of the level one customization element 711 is placed onto the post first, then the back of the level two customization element 712, followed by the back of the level three customization element 713. Then the back of the final customization element 714 is placed onto the pin post. Finally, some element such as a magnet backing 805 is put snugly onto the magnet backing 203.

Figure 9:
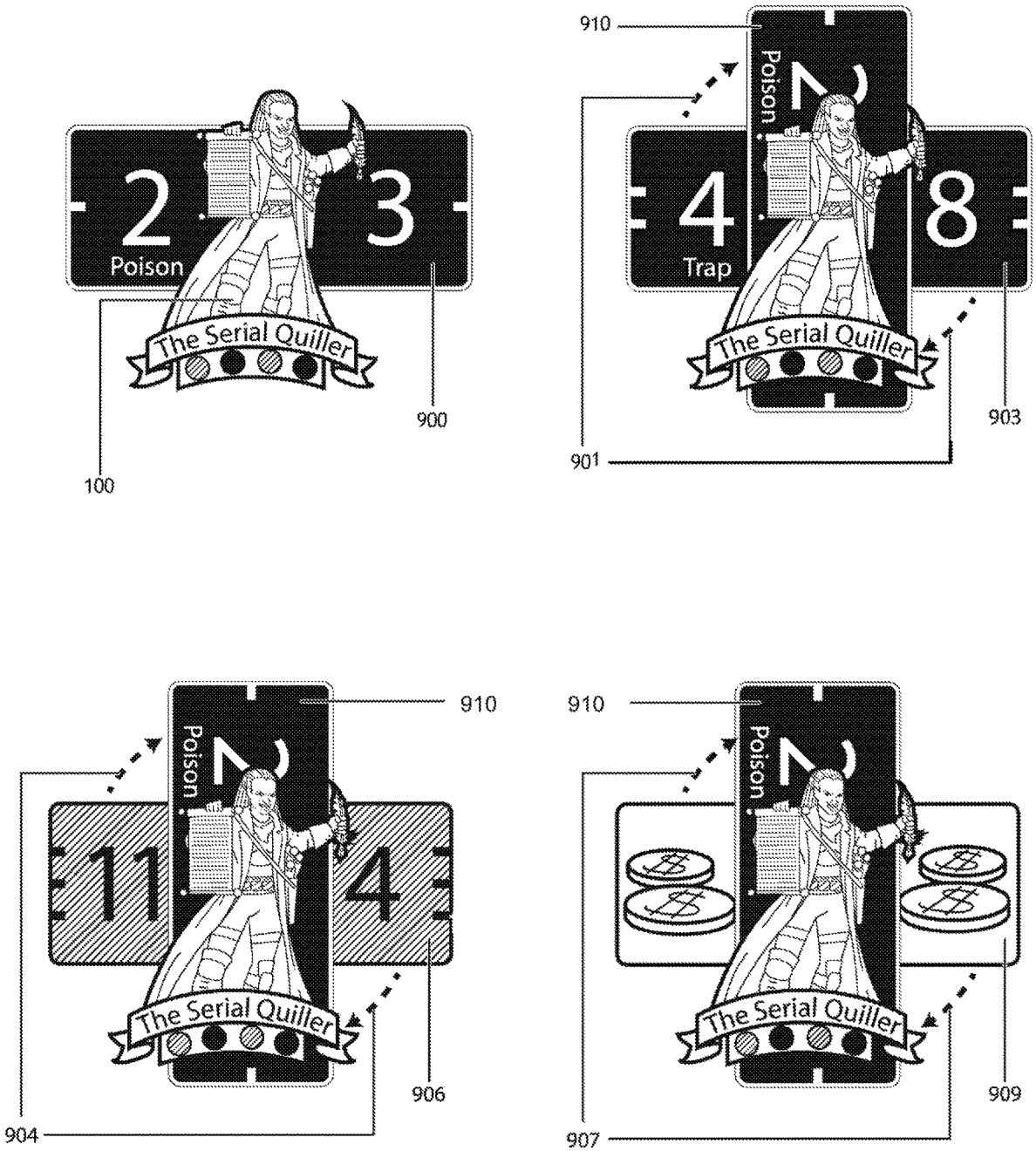
FIG. 9 illustrates the previously assembled customized character representation over the course of the method of play, according to an embodiment.

FIG. 9 illustrates the previously assembled customized character representation over the course of the method of play, according to an embodiment. depicts the previously assembled customized character representation 100 over the course of the method of play. The four selected customization elements 200 are all stacked such that only the first customization element 900 is visible, because it is on top. In an embodiment, during the method of play, the depicted character representation 100 attacks or is attacked and its top customization element is beaten, the first customization element 900 can be first rotated 901 around the post, magnet, or magnetic pole. In such a way, the first rotated 901 first customization element 900 is considered removed. The second customization element in the stack 903 is now revealed and considered that character representation's 100 top customization element 200.

In an embodiment, during the method of play, the depicted character representation 100 attacks or is attacked and its top customization element is beaten, the second customization element 903 can be rotated 904 around the pin post 204, or magnet 205. In an embodiment, both serve as a means to provide a rotatable axis that connects character representation to a backing (such as a pin backing 705 or a magnet backing 805), such that the customization elements can be rotated (e.g. first rotation 901) around the hole series 720). Generally the pin and magnet based embodiments describe a connective axis that forms the spine of the construct that comprises the character representation 100, one or more customization elements, and a backing. In such a way, the second rotated 904 second customization element 902 is considered removed. The third customization element 906 in the stack is now revealed and considered that character representation's 100 top customization element 200.

In an embodiment, the connective axis, instead of a pin or a magnet, could be a screw that is received by a nut. In another it could be a non-sharp member that is mechanically received by a snap clutch. Any suitably removable mechanical connection with an axis-forming component could similarly work.

In an embodiment, during the method of play, the depicted character representation 100 attacks or is attacked and its top customization element is beaten, the third customization element 906 can be third rotated 907 around the post, magnet, or magnetic pole. In such a way, the third rotated 907 third customization element 906 is considered removed 910. The fourth customization element 909 in the stack is now revealed and considered that character representation's 100 top customization element 200.

In an embodiment, each character representation 100 is associated with a fourth customization element 909 indicating a points value, which might be concealed by other customization elements layered on top. Regardless of the number of customization elements 200 in a stack, the final customization element 200 serves an important role. When a customization element with a particular number of points is revealed, the corresponding character representation is considered defeated, and the opposing player earns the corresponding number of points stated on that customization element.

As described above, customization elements may have indicia of one or more customization ability 330, which may modify the attack or process of attacking or being attacked. Below is an inexhaustive list of such abilities that may appear on customization elements and how the rules that apply to those abilities affect the method of play.

Boost. Indicia of the boost ability may be followed by a number. When active, the stat modified by boost is increased by the number following the indicia of the boost ability.

Cancel. When active, the cancel ability will nullify abilities of the opposing character representation's customization elements that modify the same stat as the stat modified by cancel.

Combo. When active, combo allows the character representation to add to its modified stat the value of an adjacent character representation's top customization element's stat of the corresponding type.

Evasive. When active, evasive prevents the damage that would be dealt to or by the customization element's stat which is being modified if the opposite stat of the top customization element of the opposing character representation has a different parity than the modified stat.

Frenzy. When active, the character representation must make a free attack following the current one provided the top customization element of that character representation element is not beaten and the current attack isn't already a free attack.

Guard. When a character representation is declared to be the target of an attack, the player controlling a character representation adjacent to the targeted character may opt to have the attack redirected to the adjacent character representation provided its top customization element has guard.

Heal. When heal is active and modifies the attack stat, after beating a customization element during an attack, the player who controls the customization element with heal may elect to restore a previously beaten customization element of another undefeated character representation by rotating it or otherwise placing it back on top of the stack of customization elements belonging to the chosen character. When heal is active and modifies the defense stat, after not being beaten by a customization element during an attack, the player who controls the customization element with heal may elect to restore a previously beaten customization element of another undefeated character representation by rotating it or otherwise placing it back on top of the stack of customization elements belonging to the chosen character.

Poison. When active, if the stat modified by poison deals or is dealt damage by an opposing customization element, any amount of that damage will cause the opposing customization element to be beaten regardless of whether it is in excess of the opposing customization element's defense stat.

Ranged. When active, a customization element with ranged will have its corresponding stat deal or be dealt damage prior to the other customization element dealing or being dealt damage unless both have an active ranged ability. If such damage would cause the opposing customization element to be beaten, that beaten customization element will deal no damage during the attack.

Scry. When scry is active and modifies the attack stat, after beating a customization element during an attack, the player who controls the customization element with scry may choose a character representation their opponent controls, and have them temporarily reveal its next customization element, though the top customization element is not beaten but simply moved long enough for all players to see the information on the next customization element. When scry is active and modifies the defense stat, after not being beaten by a customization element during an attack, the player who controls the customization element with scry may choose a character representation their opponent controls, and have them temporarily reveal its next customization element, though the top customization element is not beaten but simply moved long enough for all players to see the information on the next customization element.

Pierce. Damage that a customization element with pierce active would deal in excess of the defense stat of the attacked character representation's top customization element is dealt to that character's next customization element after it is revealed which may cause that newly revealed customization element to also be defeated if damage equal to or greater than its defense stat is dealt to it.

Trap. When a customization element with Trap becomes the top customization element, the character representation to which it is assigned may make a free attack following the current one. When the indicia of the trap ability is below the stat it modifies, such attack is only granted when the customization element is revealed as the result of an opposing player's character representation attacking. When the indicia of the trap ability is above the stat it modifies, such attack is only granted when the customization element is revealed as a result of its controlling player making an attack with a character representation they control.

Wild. When a character representation is declared to be the target of an attack, if the attacking character representation's top customization element has wild and it is active, the player controlling the character representation being attacked may opt to have the attack redirected to an adjacent undefeated character representation they control.

FIG. 10A Illustrates a customization element, with additional support, according to an embodiment. In some embodiments, the connective axis comprises a single member. The pin post 204 or the magnet 205 form a single member that threads through the hole serries 720 to form a rotatable assembly. A single member, however, provides only limited support. Especially, where the character representations 100 are designed to be wearable: placed on players clothing and worn for a time, additional support is an important feature.

The primary hole 1000 remains in the customization element but a second support track 1001 is also added. In an embodiment, the support track is formed to accommodate a second member. In an embodiment, it is a second pin post that is an axis distance 1008 apart from the primary hole. In an embodiment the axis distance 1008 is 17.65 mmm. The primary hole serves the axis around which the customization element 200 rotates. The support track provides a path for the second member and has both a track width 1003 and a track length 1002. In an embodiment, the track width is 1.5 mm and the track length is 25 mm. In an embodiment, the track 1001 has slightly higher tolerance for movement, being larger 1003 than the primary hole 1000 which is a whole diameter 1004 of 1 mm. In other embodiments, the hole diameter 1004 could be larger, even larger than the track width 1002, depending on the desired motion of the customization element 200. Additionally, in an embodiment. The customization element has a width 1006 and a length 1007. In an embodiment, the width 1006 35.33 mm is and the length 10007 is 74 mm. The customization element may also have a notch 1005, which, in an embodiment, is 3 mm. It is understood that sizes are variable, depending on the intended path taken in rotation and the size of the character representation.

FIG. 10B illustrates a customization element, rotated to display a customization element below, according to an embodiment. When stacked, an initial customization 1010 element serves to conceal a next customization element 1009 below it. Connected to the character representation 100 via a member threaded both through the primary hole and the support track, the initial customization element 1010 is rotated revealing the next customization element. The combination of the primary hole 1000 and the support track 1001 enable the utilization of character representations with multiple members.

Figure 11A:
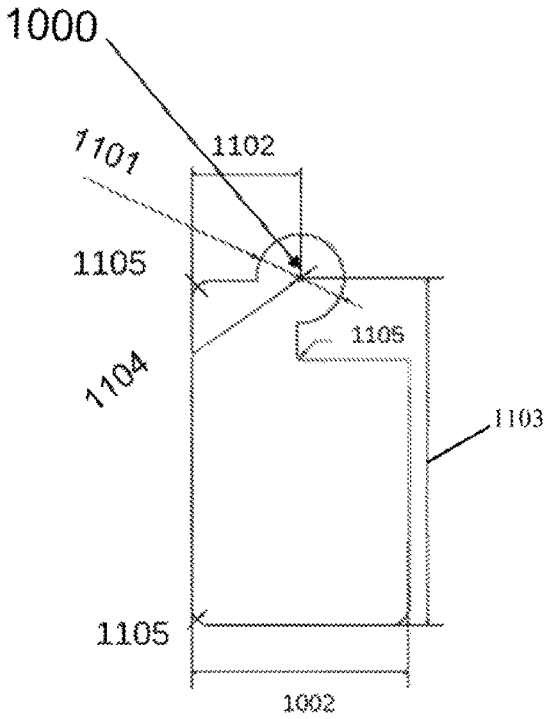
FIG. 11A illustrates a customization element, with additional support, according to an alternative embodiment.

FIG. 11A illustrates a customization element, with additional support, according to an alternative embodiment. The primary hole 1000 is now formed inside a boundary with a boundary perimeter 1101. In an embodiment, the boundary perimeter is 15 mm. The primary hole is positioned to allow the customization element to traverse around the axis formed in the primary hole by a placement that is substantial central to the part of the customization element exposed under the character representation. The centrality of the primary hole is defined by the centering width 1102 and the centering length 1103. In an embodiment, the centering width 1102 is 17.65 mm and the centering length is 56.3 mm. The primary hole has a primary diameter 1104, which, in an embodiment, is 1 mm. Also, the customization element contains a variety of notches 1105. In an embodiment each one is 3 mm. Finally, the customization element has a width 1106, which, in an embodiment, is 35.3 mm. It is understood that sizes are variable, depending on the intended path taken in rotation and the size of the character representation.

Figure 11B:
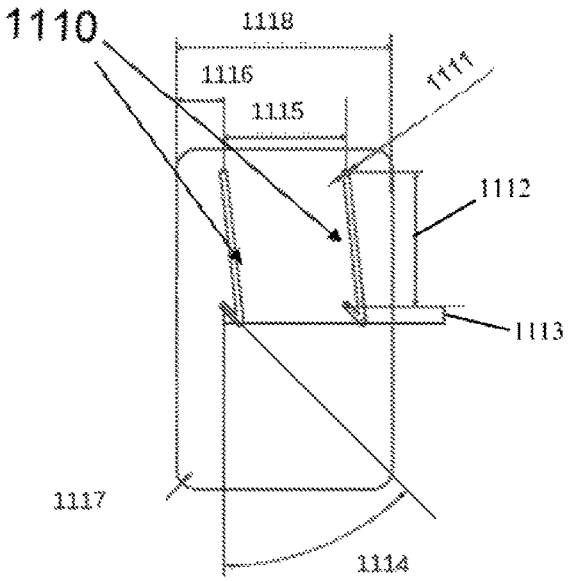
FIG. 11B. illustrates a customization element, with additional support, according to an further alternative embodiment.

FIG. 11B. illustrates a customization element, with additional support, according to an further alternative embodiment. A series of two or more support tracks in a support track array 1110 receive one or more members from the character representation 100. In an embodiment, the character representation is formed to contain two pin posts 204 with each pin post slidably engaged with the support track array 1110. Slidable engagement comes from a variety of factors. Foremost, the support track array 1110 is of a support track array width 1111. In an embodiment, the support track array width 1111 is 1 mm. The support track array is of a support track array length 1112 that will provide clearance to expose a second customization element that is underneath a first customization element by means of vertical sliding. In an embodiment, the support track array length is 21.5 mm When the customization element has traveled the full length of the support track array length 1112 it comes to the support track hook 1113. The hook is a divergence in the support track array 1110 that is able to hold the customization element in a position that is removed 910 for purposes of play. Removed 910, in the present embodiment, means physically displaced such that a second customization element below is visible and that the first customization element is no longer prominently displayed along with the character representation 100.

In an embodiment, the support track hook 1113 is 2.7 mm in length at a particular support track hook angle 1114. In an embodiment, the support track hook angle 1114 is 45 degrees. The support track hook length 1113 and the support track hook angle 1114 operate to hold the support element in a location making visible the customization element below it and can be executed in a wide range of lengths and angles. Further still, the support track array can accommodate a wide configuration of members. In an embodiment, the support track array comprises two tracks that are an array distance apart 1115. In an embodiment, the array distance 1115 is 20 mm. In other embodiments, the support track array 1110 is comprised of 3 or more tracks, with varying configurations of support track lengths 1112, support track hook lengths 1114, and support track hook angles 1115. Additionally, the support track array has a border width 1116 from the edge of the customization element. In an embodiment, the border width is 7.5 mm. In an embodiment, the customization element further contains notches 1117 which, in an embodiment, are 3 mm. The customization element, with the track array, is also a track array customization element width 1118, which, in an embodiment, is 35 mm.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A game system comprising:

a pin having a front surface and a back surface opposite the front surface;

a first pin post extending from the back surface of the pin;

a second pin post extending from the back surface of the pin; and two or more cards, each card defining a central hole and a track extending around the central hole;

wherein the first pin post is positioned through the central hole of each of the two or more cards and the second pin post is positioned through the track of each of the two or more cards such that each card can independently rotate about the first pin post with the second pin post traveling along the track and limiting rotation of the card.

2. A method of playing a game comprising:

providing a first player set including a pin having a post extending therefrom, a first combat card defining a central hole, the first combat card including an attack indicia and a defense indicia, a second combat card defining a central hole, the first combat card including an attack indicia and a defense indicia, and a points card defining a central hole, the points card including a points indicia, wherein the post of the pin is positioned successively through the central hole of the first combat card, the central hole of the second combat card, and the central hole of the points card such that each card can independently rotate about the post;

wherein, the first combat card, the second combat card, and the points card of the first player set are each provided in an initial position relative to the pin in which only the first combat card is visible such that the first combat card of the first player set is an active combat card of the first player set, the attack indicia of the first combat card of the first player set is an active attack indicia of the first player set, and the defense indicia of the first combat card of the first player set is an active defense indicia of the first player set;

providing a second player set including a pin having a post extending therefrom, a first combat card defining a central hole, the first combat card including an attack indicia and a defense indicia, and a second combat card defining a central hole, the first combat card including an attack indicia and a defense indicia, and a points card defining a central hole, the points card including a points indicia, wherein the post of the pin is positioned successively through the central hole of the first combat card, the central hole of the second combat card, and the central hole of the points card such that each card can independently rotate about the post, wherein, the first combat card, the second combat card, and the points card of the second player set are each provided in an initial position relative to the pin in which only the first combat card is visible such that the first combat card of the second player set is an active combat card of the second player set, the attack indicia of the first combat card of the second player set is an active attack indicia of the second player set, and the defense indicia of the first combat card of the second player set is an active defense indicia of the second player set;

comparing the active attack indicia of the first player set to the active defense indicia of the second player set, wherein, if the active attack indicia of the first player set is greater than the active defense indicia of the second player set, the active combat card of the second player set is rotated about the post to a second position such that a next visible combat card of the second player set in the initial position becomes the active combat card of the second player set with the attack indicia of the next visible combat card becoming the active attack indicia of the second player set and the defense indicia of the next visible combat card becoming the active defense indicia of the second player set; and comparing the active attack indicia of the second player set to the active defense indicia of the first player set, wherein, if the active attack indicia of the second player set is greater than the active defense indicia of the first player set, the active combat card of the first player set is rotated about the post to a second position such that a next visible combat card of the first player set in the initial position becomes the active combat card of the first player set with the attack indicia of the next visible combat card becoming the active attack indicia of the first player set and the defense indicia of the next visible combat card becoming the active defense indicia of the first player set.

* * * * *